US006908005B1

(12) United States Patent
Strube et al.

(10) Patent No.: US 6,908,005 B1
(45) Date of Patent: Jun. 21, 2005

(54) TEMPORARY BURST STOPPAGE IN A SHEET METAL TOP

(75) Inventors: Lutz Strube, Cremlingen (DE); Peter Hoeft, Braunschweig (DE)

(73) Assignee: Schmalbach-Lubeca AG (DE)

( * ) Notice: Subject to any disclaimer, the term of this patent is extended or adjusted under 35 U.S.C. 154(b) by 0 days.

(21) Appl. No.: 09/807,108

(22) PCT Filed: Oct. 8, 1999

(86) PCT No.: PCT/EP99/07564

§ 371 (c)(1),
(2), (4) Date: Oct. 24, 2001

(87) PCT Pub. No.: WO00/21846

PCT Pub. Date: Apr. 20, 2000

(30) Foreign Application Priority Data

Oct. 8, 1998 (DE) ..... 198 46 243

(51) Int. Cl.[7] ..... B65D 17/34
(52) U.S. Cl. ..... 220/269; 220/906
(58) Field of Search ..... 220/269, 270–273, 220/906, 274, 275, 276, 277, 278, 284; 413/16, 12, 17, 15, 8

(56) References Cited

U.S. PATENT DOCUMENTS 3,303,959 A * 2/1967 Brown ..... 220/273
3,315,837 A * 4/1967 Boik et al. ..... 220/273
3,406,866 A 10/1968 Jasper
3,762,598 A * 10/1973 Gayner et al. ..... 220/273
3,968,899 A 7/1976 Jordan ..... 220/266
4,348,464 A 9/1982 Khoury ..... 428/571
4,928,845 A 5/1990 Doyle ..... 220/271
5,375,729 A * 12/1994 Schubert ..... 220/271
5,860,553 A * 1/1999 Schubert ..... 220/271

FOREIGN PATENT DOCUMENTS

EP 0 820 409 B1 3/2000
GB 1164179 9/1969

* cited by examiner

*Primary Examiner*—Lien M. Ngo
(74) *Attorney, Agent, or Firm*—Duane Morris LLP

(57) ABSTRACT

A can end made of sheet metal for containers which in a closed state has an increased inner pressure compared to an ambient pressure. The can end includes a substantially flat central panel, a portion in the central panel is smaller with respect to the panel, and is adapted to be broken out of the panel by tearing. The smaller portion is defined by a score line, and a tab that is adapted for gripping and serving for opening the smaller portion. The tab is mounted at the central panel. In a longitudinally limited section of the can end, following a starting portion of the score line, at least one of a metal structure and structure lines of the sheet metal below the score line have a substantially higher density compared to a metal structure of the sheet metal below at least adjacent score line sections for temporarily blocking the opening process, which is difficult to control, after initially breaking or tearing open the score line.

24 Claims, 6 Drawing Sheets

TEMPORARY BURST STOPPAGE IN A SHEET METAL TOP

The invention relates to a metal end comprising an opening system for containers, such as beverage cans, which, in a closed state, are under one of overpressure and low pressure, and to a method of manufacturing said end. Such cans, particularly beverage cans having a carbonized content, may have an inner pressure of about 3.0 to 5.8 bar before the can end is opened (with said opening system), said pressure depending on the content, the filling ratio, the storage temperature and the treatment during transport. When initially opening an openable segment, a score line for opening the container, which score line breaks due to shearing forces, firstly breaks open close to one of a pull and a pressure portion of a gripping tab. The opening process causes an openable area segment defined by a score line and located on the central panel to burst out uncontrolledly or abruptly as a result of a spontaneous dynamic effect of the very high inner pressure. A danger of injury for hands, face and eyes arises therefrom.

To avoid said danger and to control said spontaneous opening process, known can ends are provided in a predetermined limited section of the score line with a larger, i.e. less weakened, remaining wall thickness under said score line, compared to the adjacent sections of said score line. By correspondingly selecting a relative position of said short section of the score line in relation to a section of the score line at which the opening process starts, the score line is adapted to initially break only up to said predetermined blocking position at which breaking is stopped, so that a pressure compensation between the inside and the outside of the container may take place, following which the opening process may be terminated without risk. Thereby it is avoided that the opening segment opened manually by a gripping tab, bursts out uncontrolledly due to the high inner pressure or even tears out and flies out of said can end or spontaneously bursts out of said opening.

Opening stoppages of the above mentioned type have been used successfully with the different types of openable can ends, thus with can ends, where the opening segment together with the gripping tab is completely detached from said can end, as well as with can ends, where the tab and the opening segment remain at said can end also after opening, the opening segment being for example turned into the inside of the container (SOT can end).

To avoid a risk of injury, the usual test guarantee for beverage cans is at minimum 6.2 bar (90 psi or 620 kPa). A score line, firstly limiting or blocking (shortly: stopping) an initial opening process, may also be used with other containers, e.g. low pressure containers. When used with tennis ball cans, it provides burst stoppages also in a pressure range between 1.5 bar (150 kPa) to 2.5 bar (250 kPa).

The known system has proved successful in practice, however, it is subject to different critical problems in manufacturing, said problems requiring a high expenditure of control. Due to the increased remaining wall thickness in the stopping portion, an increased wear of a scoring rib which provides the embossment, is disadvantageous for an exact control of the subsequent opening process. This may cause the separating process not (no longer) to be continued exactly along said score line, when further tearing out said opening portion after a temporary stoppage. A further problem is that in said stopping portion uncontrollable or too high opening forces are necessary, which in case of a too large remaining wall thickness may have the effect that the opening process cannot be continued and terminated. On the contrary, when the remaining wall thickness is too small, the protective effect may be missing since a temporary stoppage of the opening process does not take place at all or not securely enough. Particularly, when the score line is adapted to have a pointed end and two burst stoppages are required on both sides of a rounded point, from which also two score line sections originate, the known conception has not proved successful.

It is an object of the invention to avoid the mentioned difficulties with simple means and to propose a metal end comprising a temporary burst stoppage which has a more versatile field of application, as well as a method of manufacturing such an end.

In a predetermined limited (short) length or section of a score line, a remaining wall thickness substantially corresponds to a remaining wall thickness in adjacent, particularly remaining sections of said score line and does not markedly differ therefrom. A temporary stoppage of an opening process is obtained by providing a metal structure in said selected, i.e. predetermined and limited length of said score line, which metal structure in said wall remainder substantially differs from the structure in the adjacent sections of said score line.

After manufacturing said score line, said metal structure is modified by being compacted. A relief of embossed tensile stresses is obtained by said compaction. Whereas, in the remaining score line section, following its purpose sheet metal is weakened and, below said score line, tensile stresses are more or less programmed by providing said score line, said tensile stresses resulting from a lateral displacement of the material and thus favoring bursting, said programmed tensile stress is reduced to completely compensated in said short section serving as a temporary stoppage at the moment of pressure compensation. Said compensation provides a reduction of the disposition for shearing or transverse elasticity, thus strengthening a transverse resistance of the metal in relation to its tensile strength, said transverse resistance in any case being 20% smaller. It is true that it would also be possible to reduce the disposition for transverse elasticity by reducing the embossment depth in the stopping section, but in this case, only a theoretic optimum may be achieved between the height of the remaining wall—causing the stoppage—and the suitability of the remaining wall for shearing off, when the user causes a continuation of the opening process. Possibly, the optimum may be detected theoretically, however, in the course of the manufacturing process, said optimum is continuously changed to provide score lines of an inferior quality, the remaining embossing rib or scoring rib being subject to wear and the differences between score line and reduced embossing depth are no longer absolutely correct or change. Consequently, when opening, the shearing-off line leaves the trace of the score line when the temporary opening stoppage was too intensive, i.e. the remaining wall required a too high transverse force to be opened. When, however, the remaining wall is to weak, its temporary stopping effect does not develop, but it tears out immediately and completely, when pressure escapes spontaneously.

Surprisingly, it turned out that said metal structure temporarily stops an initial opening process reliably and at a predetermined position of the score line, so that the required and desired protective effect against the above described risks is reliably achieved. On the other hand, it came out that the scoring tool or a corresponding scoring rib have longer service lives. Said longer service lives may also be favored by positioning an additional embossing tool with laterally embossed line pieces outside of the real score line. Thus, a control of the opening process is not obtained by the tool providing the score line, but by another tool, providing additional score pieces which may be controlled better and also adapted more easily with regard to their depth, length and distance from the real score line. Thus, it is possible for example to exchange said additional tool, to modify said score pieces with respect to their width, length or distance from the real score line in order to program different opening processes and to predetermine them in the can end. With usual embossing tools, having an embossing tool with a portion of reduced height, such control methods are only possible when modifying the entire tool with its complete embossing tool. This is substantially more expensive, substantially more ineffective and substantially more complicated than a simple control of two additional embossed beads on the left side and on the right side of the real controlling path. Even the position of the short embossed pieces on both sides of the score line may be modified to obtain a modified bursting behavior of the initial opening process, to test it on a larger scale and to lead it to an optimum, than this is the case with a multitude of specifically produced embossing tools.

By embossing compacted line sections on both sides of the score line, the real score line for opening is reduced in width. The walls determining said width and being located on the left and on the right of the embossed indentation with the bottom positioned below, change after a second engagement of said embossing tool. Preferred values are a reduction to 30% to 70% of the original width, particularly at least 50% (claim 16). When a greater reduction is effected by a stronger compaction of the material from outside towards the score line, also the score line bottom may disappear completely, being reduced to a circular form open on the top. In any case, the walls are adapted to have a somewhat steeper slope and to closer approach each other, the change in slope and the reduction of width being depended on the depth and the width of the embossed line sections on both sides of the score line.

Also, the tools necessary for manufacturing the structural modification obtained by a score line section reduced in width are substantially more stable and not as susceptible to wear as a usual scoring rib (also embossing rib) non-uniform or irregular with respect to its engagement height (or depth).

A structural modification is effected by acting on the can end sheet metal from outside of the score line.

Said action on the sheet metal outside of said score line may be effected from any convenient direction, i.e. from the sides or from below, in any case the effect is directed such that the can end material and the material structure below the score line serving for opening is compacted, particularly a material structure free from tensile stresses being obtained by a strong lateral action. Such a neutral, stress-free zone is substantially more stable from a mechanical point of view and provides a temporary opening stoppage or blockage at a constant score line depth along the entire starting section of the score line serving for opening and also beyond it, said stoppage or blockage being able to compensate a spontaneous escape of the pressure resulting from a pressure difference with respect to the environment. After pressure compensation, said temporary stoppage may be overcome by the user of the gripping tab by continuing the opening process, so that the openable segment is opened up exactly keeping the track of the score line. Therefore, said temporary stoppage is not a permanent stoppage, when the user overcomes a mechanically compacted or hardened wall remainder shortly after the beginning of an opening process by a mechanically increased force.

A modification of the material structure is easily conceivable when two short score line pieces are embossed directly adjacent to the score line serving for opening. In prior art, the blocking section usually was a section which was less compacted or which had a looser structure, since the wall remainder was adapted to be stronger, and thus an initial opening process was temporarily interrupted. According to the invention, the thickness of said section is substantially equal to the section of the score line located in front of and behind said portion. Nevertheless, a mechanical compaction is provided by a lateral pressing-in of material by embossing lateral pieces, said compaction providing a controlled opening after a spontaneous escape of an overpressure or a spontaneous compensation of a low pressure.

The score line according to the invention may have a substantially uniform depth. The mentioned reduction of tensile stresses below the score line may be provided from one side or from both sides of the openable score line. When the temporary blockage is intended not to be mechanically too strong, a very short length or longitudinal section is recommended as unilaterally or bilaterally offset score line sections which, however, are located very closely to the starting portion, i.e. closely adjacent to the initial break-in section of the score line.

The depth of the two short score line sections adjacent to the main score line may be controlled. By controlling said depth, the material compaction below said main score line may be controlled with respect to its shape and relief of tensile stresses. The greater the depth, the stronger the relief of tensile stresses below the groove bottom of the main score line and the stronger the burst stoppage when opening the limited opening segment. For a sheet metal thickness in the range of 0.22 mm to 0.24 mm, the depth of the additionally embossed line sections may be between 0.17 mm and 0.08 mm, thus particularly having a greater depth than the main score line serving for opening.

An increased depth of the laterally offset and longitudinally limited compressed sections permits a stronger and controlled relief of the material structure below the openable score line. Said controlled relief by said additional score line sections (pieces) results in a steeper slope of the flow or structure lines below the stopping section of the score line in relation to the remaining section, said slope being obtained by compressing the sheet metal in said section. Simultaneously, the wall sections of the score line are designed to be steeper, said wall sections anyhow being less distant from each other in said stopping section than in at least the adjacent section of the score line, (up) to the entire remaining section of the main score line.

A rounded profile at the bottom of the lateral compacted section has a preferred effect on the stopping section located below said openable score line, throughout a greater depth range in direction of a compaction of the structure lines or flow lines, said score line having a smaller width, its walls closer approaching each other.

As far as the term "score line" has been used, the expert thereby also understands an embossed line or a scored line or a weakened line which has been provided by other means and is adapted to separate a tear-out segment for opening from a remaining central panel of a can end by shearing forces; terms like tear-out or break-out shall be regarded as technically equivalent. An interlocking is a compaction of the structure lines/flow lines of the metal.

In the following, the invention is described more in detail on the basis of embodiments.

FIG. 1 shows on the left half "a" a top plan view of a can end 1 to be opened by tearing, and on the right half "b" a corresponding portion 4 adapted to be broken out by tearing it along a score line 8, said portion being separated or detached completely from the can end by a gripping tab 6.

FIG. 2 shows on the left half "a" a top plan view of another can end 9 to be opened by tearing and made of sheet metal, and on the left half "b" an opening segment 12, said segment being limited by a score line 11 and remaining at said can end together with a gripping tab 14 also after opening.

FIG. 3 is a sectional view of a can end showing in an enlarged cross-section a short section 7,7*a* of the score lines 11 or 8, said short section being provided to stop an initial opening process.

FIG. 4 is a top plan view similar to that of FIG. 1*b* illustrating an opening segment 22 in a central panel 20 being provided with a stopping portion by short score lines 27*a*,27*b* according to an embodiment of the invention, for stopping an initial opening process.

Figure 8:
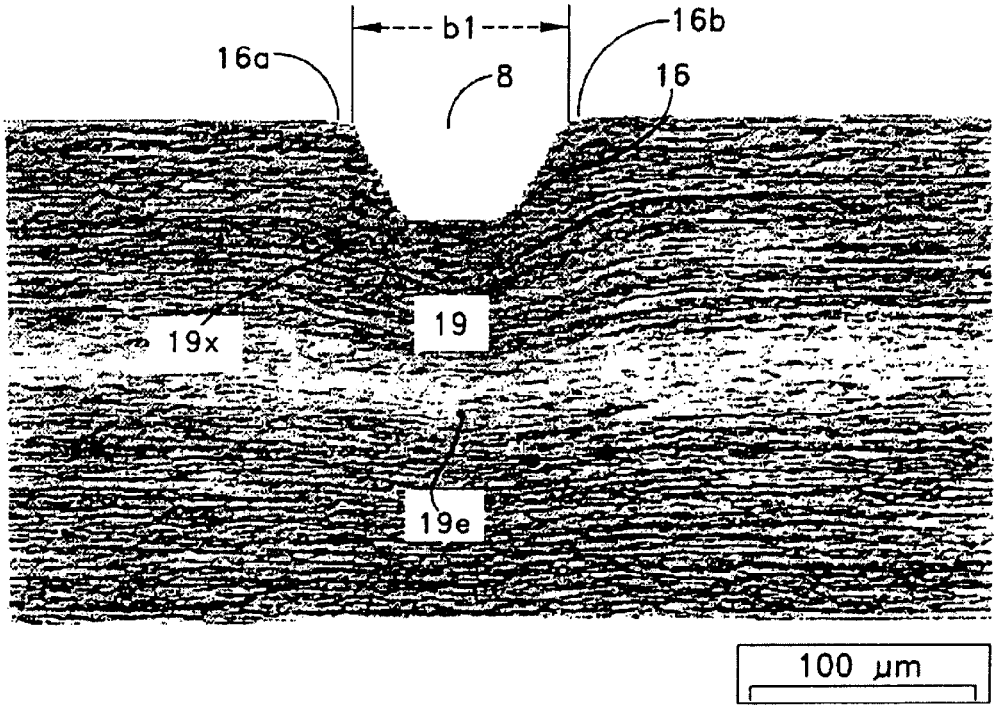
FIG. 8 is a more exact illustration based on FIG. 3 and showing structure lines or "flow lines" of the sheet metal in a section of a score line 8. The stopping or blocking section 7 of FIG. 1 of said score line is shown in a cross-sectional view to have a trapezoidal channel being embossed from the surface of the central panel.
Figure 8A:
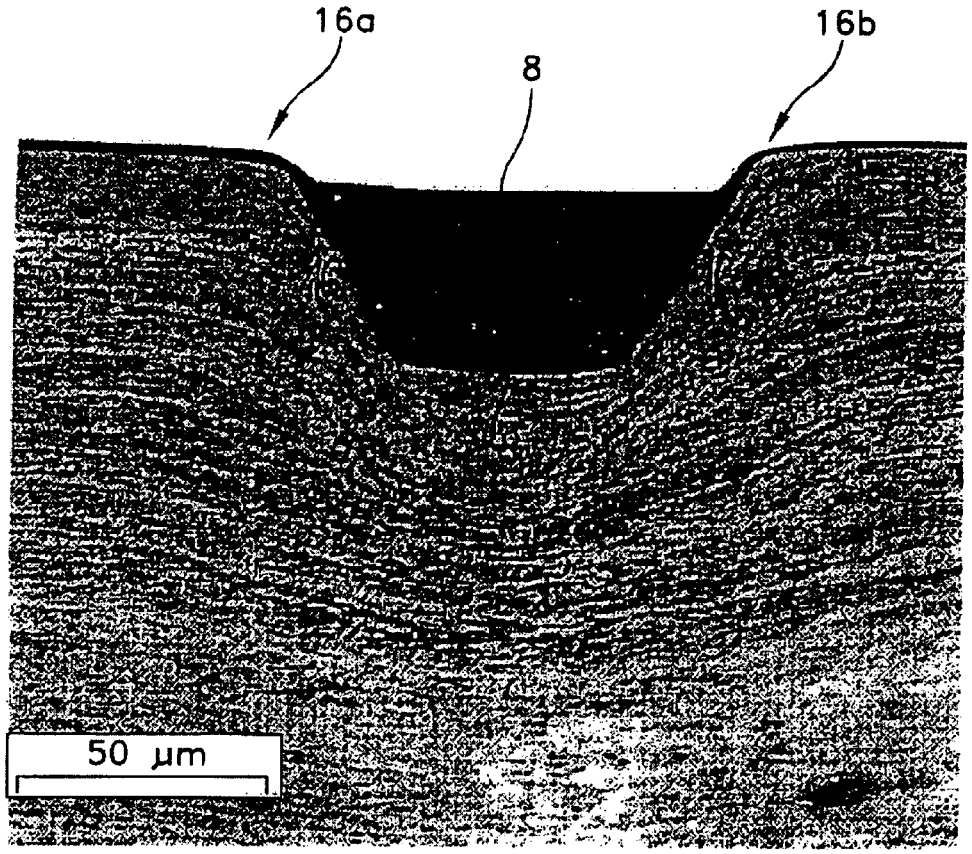

FIG. 8*a* is a selective enlargement of FIG. 8 at a scale enlarged by the factor 2, illustrating more in detail a score line bottom 8*g* and two walls 16 of the score line as well as the extension of the flow lines of the metal.

Figure 4:
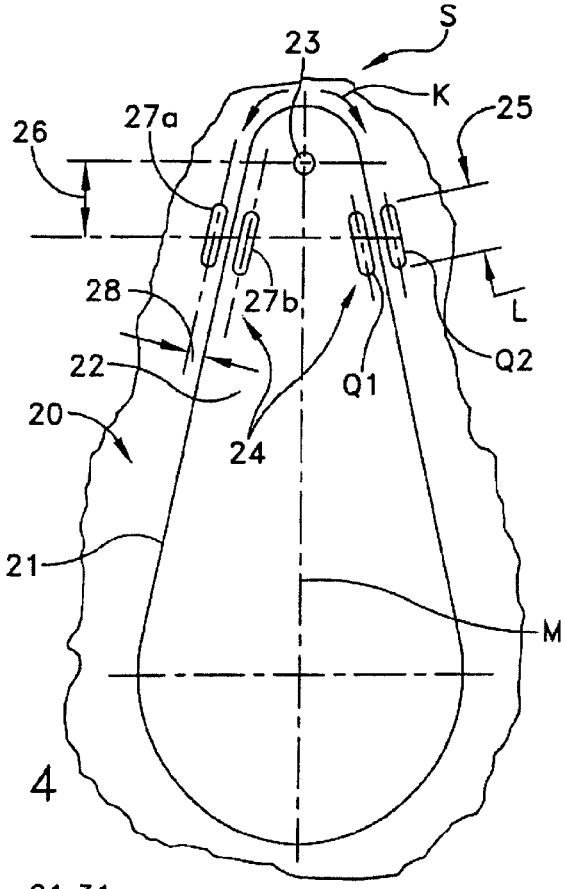
Figure 6:
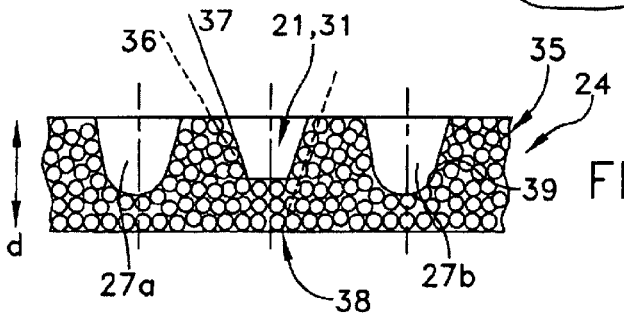
FIG. 6 is an illustration similar to that of FIG. 3 showing a cross-section through a can end according to one of FIGS. 4 and 5, said can end having a sheet metal thickness d and being shown in a simplified illustration with grains instead of flow or structure lines which result from connecting the centers or central points.
Figure 9:
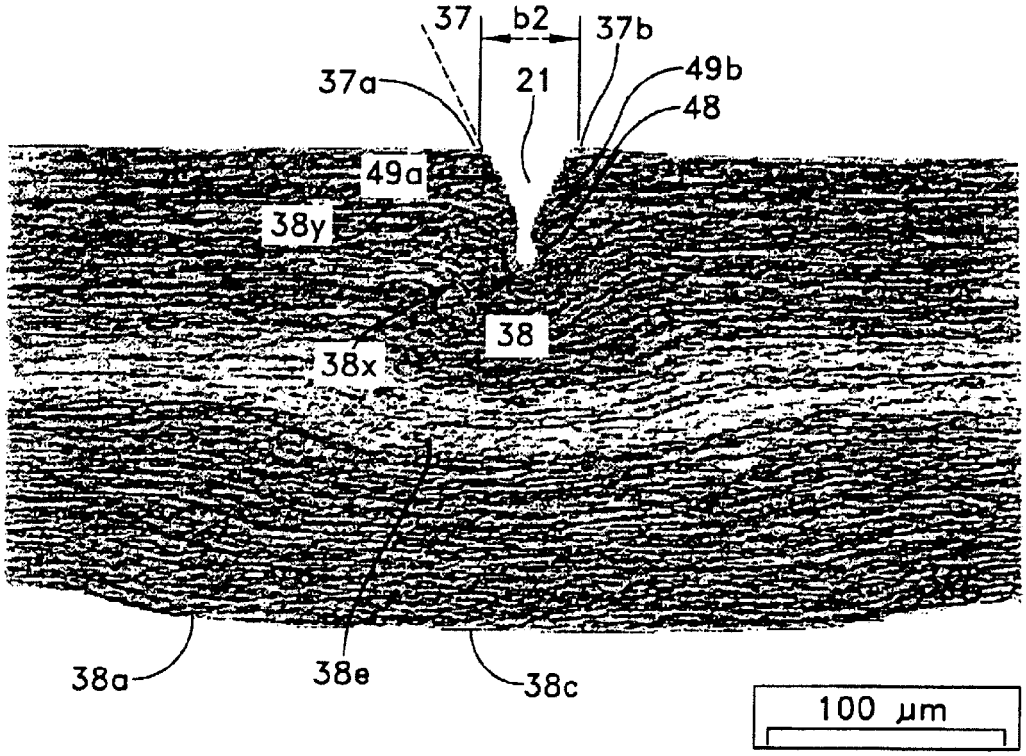

FIG. 9 is a comparable more exact illustration than in FIG. 6, namely showing flow lines of a short section 24 according to FIG. 4, without illustrating the lateral embossments Q1,Q2 and 27*a*,27*b* of FIG. 4.

Figure 9A:
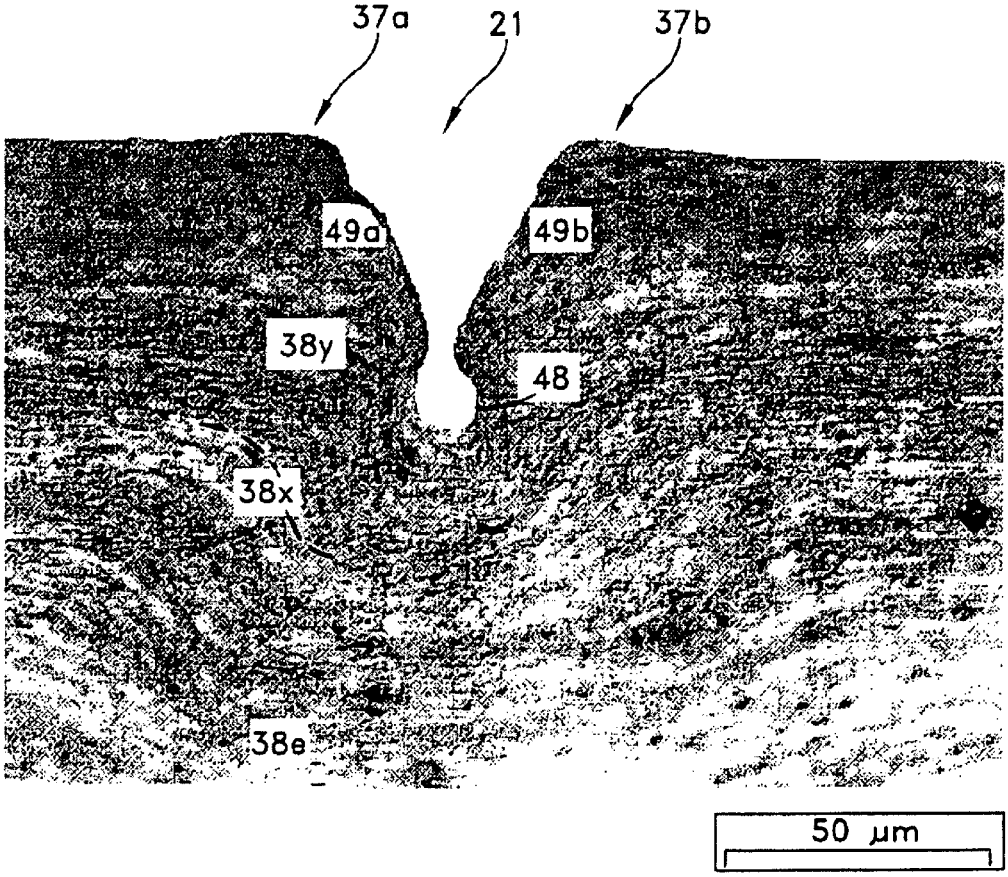

FIG. 9*a* is a selective enlargement at a scale enlarged by the factor 2, only showing the area of the score line section 24 between the two embossments Q1,Q2 which are not illustrated here.

FIG. 1*a* shows an openable can end 1 being provided with a seamed edge 2 at a central panel 3. In said central panel, an opening portion or segment 4 adapted to be broken out by tearing is defined by a score line 8, said portion, for opening the container, being designed to be separated or detached completely from said can end with the help of an annular gripping tab 6 which is fixed with a rivet 5 at said opening portion 4. Said score line is caused to initially break open in the area of said rivet 5 by tilting said gripping tab 6 in upward direction with respect to said central panel. By raising or pulling said gripping tab 6 in upward direction, the opening process may then be continued by tearing further along said score line 8 until said opening portion 4 is completely detached.

In FIG. 1*b*, said opening portion 4 is shown at an enlarged scale. Reference numeral 5*a* designates the fixing position of said gripping tab 6. Close to said tab, on both sides of said fixing position, a tightly limited section 7 is provided, which serves for temporarily stopping said opening process after an initial break of said score line, so that a pressure compensation may take place without a risk for the user, before said opening process is continued by pulling at said gripping tab 6.

FIG. 2*a* shows the same situation for a sheet metal can end of another type.

FIG. 2*b* also illustrates an opening portion 12 at an enlarged scale. The fixing position for the gripping tab is located at 13*a*, thus outside of the opening portion. In this case, too, a lever-type gripping tab 14 is moved in upward direction for opening. It turns over its fixing position 13 and presses said opening portion 12 into the inside of the container. The opening process starts close to said fixing point 13*a*. Close thereto, again similar means 7*a* are arranged for temporarily stopping the initial opening process.

Figure 1:
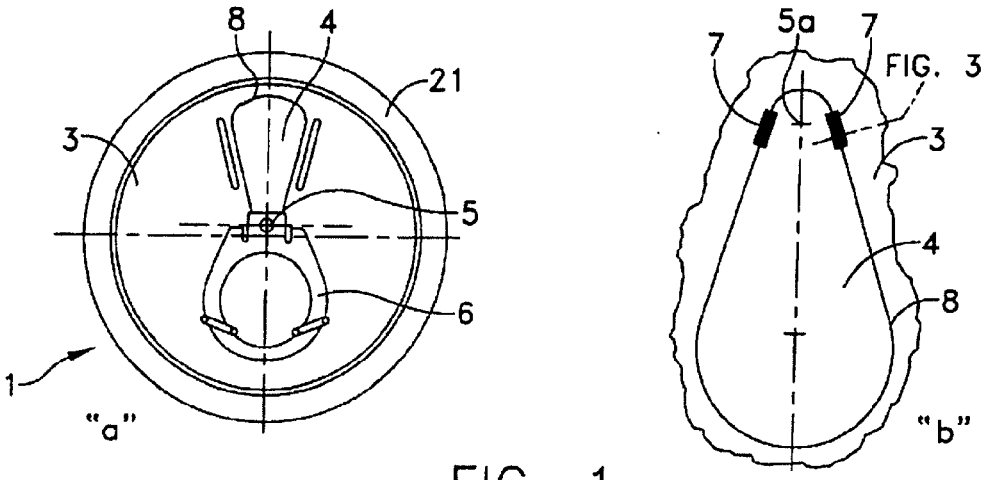
Figure 2:
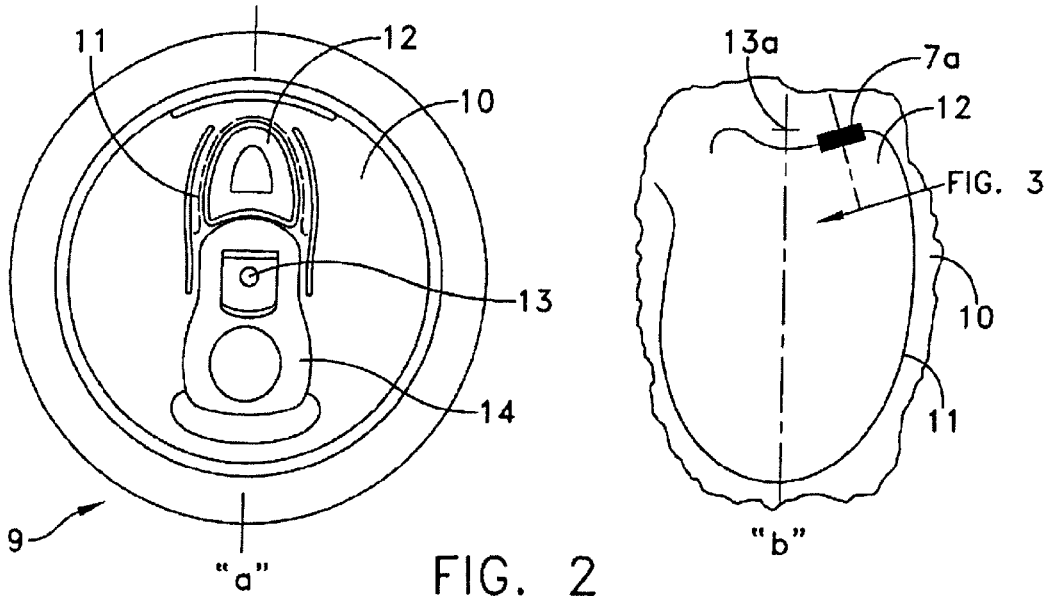

FIGS. 1 and 2 show usual can ends made of sheet metal and having a "central panel" 10,3 and a seamed edge 2.

Figure 3:
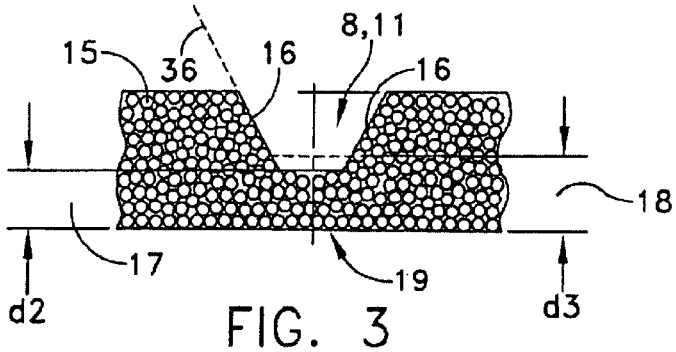

FIG. 3 illustrates a usual type of a stopping means 7,7*a* for temporarily stopping an initial opening process. Reference numeral 15 designates a score line section 8 or 11 of a can end sheet metal. Reference numeral 17 designates a normal remaining wall thickness d2 below said score line. In an accentuated portion of said stopping means 7,7*a*, a larger remaining wall thickness d3 below said score line is provided, as indicated by reference numeral 18. The metal structure 19 below said score line is squeezed, but otherwise not substantially modified. The walls 16 of said score line 8,11 (often also called "embossed line") are inclined resulting from an embossment provided by an embossing tool or a scoring rib tool. The schematic illustration of FIG. 3 is illustrated more clearly by a real section through a sheet metal can end at a corresponding enlarged scale according to FIG. 8 and FIG. 8*a*. Said figures show sections 7,7*a* of the trapezoidal score line of FIGS. 1,2, the illustrated remaining wall thickness being larger than the rest of a wall remainder which is not visible in FIGS. 8,8*a*, said rest of the wall remainder of the remaining score line 8, which is embossed more deeply, being reduced.

FIG. 8 shows an accentuated flow line 19*x* in a metal structure 19 below a score line. Also visible is the effect of an embossment of a portion 19*e* further below said score line, said flow line giving an attenuated reproduction of the score line. The lower surface of the can end is flat and unchanged in said portion 7 with respect to the remaining lower surface. The side walls 16, which have a sloped extension in upward direction, proceed directly into the upper surface of the central panel at transitions 16*a*, 16*b*. As a result of the embossment, said direct transitions are even slightly lowered in relation to an imagined flat surface plane on the central panel. Said direct transition 16*a*, 16*b* at the upper edge portions of said score line is distinctly visible particularly from the enlarged illustration of FIG. 8*a*, a score line bottom 8*g* of said score line 8 corresponding to that of FIG. 8. Said score line bottom 8*g* is narrower than a width b1 of said score line between said transitions 16*a*, 16*b*, said width being designated b1 in FIG. 8.

In FIGS. 4 to 7, the stopping of the initial opening process has other reasons for equal types of can ends as in FIGS. 1 and 2. The position of the stopping portion in relation to the fixing positions 5*a*,5,13*a*,13 of the gripping tabs 14,6 is substantially equal to that of FIGS. 1 and 2.

FIG. 4 shows an opening portion 22 at an enlarged scale corresponding to the opening segment 4 of FIG. 1. Said opening portion 22 is limited by a continuous score line 21. Close to the narrower end of said opening portion, which in this embodiment is provided as a drop-shaped segment, a fixing position 23 for a (lever-type or pull-ring-type) gripping tab is provided. This is the "starting portion" S of the opening process which continues by opening said score line along a path K. At a small distance A from said starting portion S, limited sections or lengths 24 are provided on both sides of a center line M of said opening portion, said limited sections or lengths serving for temporarily stopping said opening process. A designates an average distance 26 of said limited sections or lengths from said fixing position 23. According to a concrete embodiment, said average distance may be about 1.5 to 3.5 mm, i.e. it is somewhat further distant from said position 23 than the stopping means 7,7*a* of FIG. 1,2.

The score line 21 is provided by a uniform embossing tool to continuously have a constant depth. Further, it has the same remaining wall thickness d2 at said section 24, than at the adjacent, particularly the entire remaining score line section.

FIG. 6 illustrates that the metal structure 38 at said section 24 of the can end sheet metal 35 below said score line 21 is substantially modified, such that the metal structure of said section is free from tensile stresses compared to the metal structure in the adjacent wall remainder portions. Said metal structure of a higher density provides a sufficient stopping effect for an initial opening process, also when high pressure differences have to be compensated, so that a modification of the score line depth k2 is not necessary.

The higher density of the metal structure is not achieved by a modified effect of the embossing tool, but by substantially modifying the metal structure with regard to its flow or structure lines by a longitudinally limited squeezing or stamping method 27*a*;27*b* and Q1,Q2, respectively, from one side or from both sides of said score line 21.

It has been found, that already a unilateral squeezing provides a sufficient relief of tension of said metal structure 38. However, a bilateral squeezing is preferred, as shown in FIGS. 4 to 7. For this purpose, a bead or a score line piece 27*a*,27*b* is embossed in a line-shape at a distance 28 from the center of the score line and in parallel with respect to the limited section 24 of said score line, said distance substantially or at least corresponding to the width of the score line. The distance from the score line serving for opening to the embossed bead or score line piece may, according to a concrete embodiment, substantially be 0.5 to 1 mm. A preferred length L of the score line pieces or sections 27*a*,27*b* in said limited length 24 may substantially be between 1.5 and 6 mm. By said short score line pieces adjacent to the real score line, the metal structure in the remaining wall (thickness) portion of the score line serving for opening is mechanically shaped throughout a substantially equal length. The remaining wall thickness of one of the adjacent and further distant score line segments is not subject to a deformation of the metal structure.

The score line pieces 27*a*,27*b* may be embossed simultaneously with the manufacturing of the score line. They may also be embossed subsequently in a separate manufacturing step. In the latter case, the slope of the walls of the openable score line changes at section 24, as illustrated by an unbroken wall 37 compared to a broken wall 36 according to FIG. 6.

Figure 7:
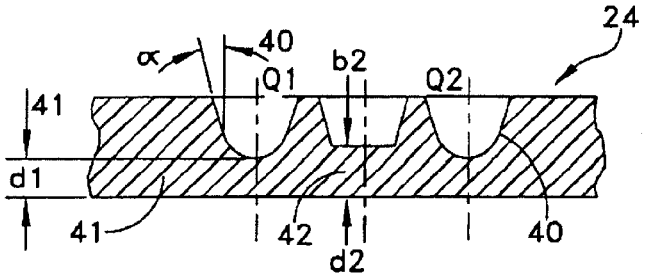
FIG. 7 is a sectional view similar to that of FIG. 6 for explaining further details.

Preferably, the score line pieces Q1,Q2 have a slightly deeper extension than said score line 21 serving for opening, as can be seen on FIG. 7. It may be useful to round the bottom contour 39 of the score line pieces in contrast to a trapezoidal cross-section of the score line. Thus, the wall remainder 42 having a thickness d2 below the score line at said section 24, is somewhat larger than a thickness d1 of the wall remainder 41 below said score line pieces Q1,Q2. A flank angle 40 of the additional score line pieces should substantially be $5° \leqq \alpha \leqq 15°$.

The shaping of the limited section 24 of the score line, which is schematically illustrated on FIG. 6, is obvious more clearly from the real cross sectional illustrations of FIGS. 9,9*a*, which show said section 24 in a cross-sectional view and in an enlarged view at a scale indicated thereon, the lateral score line pieces 27*a*,27*b* and Q1,Q2, respectively, not being visible on pictures of surface ground cuts since they are located outside of the picture range.

Basically, said section 24, which extends in perpendicular direction with respect to the paper plane, is provided with a score line shape 8, having a width b1, as illustrated in FIG. 8, only the score line bottom 8*g* extending somewhat more deeply, corresponding to the normal score line depth leaving a bottom remainder of a height d2 according to FIG. 3. After providing score line pieces Q1,Q2 which are laterally spaced from each other and may be effected by embossing tools, said section 24 of the score line of FIG. 4 has a shape as shown in FIG. 9. The structure is substantially modified, also the shape of the score line in this particular embodiment is substantially modified with respect to a trapezoidal shape. The modification in shape depends on the depth, the width and the distance of the score line pieces Q1,Q2 from the center of said score line 8 in said section 24.

FIG. 9 in combination with the detailed illustration of FIG. 9*a* shows that the bottom of the can end is curved or vaulted 38*c* in transitional sections 38*a* and 38*b*, material being pressed from outside below said score line 8 in the non-modified shape and below said score line 21 in the modified shape. Thereby the structure lines change, they become denser, and a portion 38*e* below said score line is provided with a stronger deformation in downward direction with respect to the flow lines, corresponding to said curvature 38*c* with a first transitional portion 38*a* and a second transitional portion 38*b* towards the remaining bottom side of the can end.

Flow lines 38*y* and 38*x*, which in an area 38 below said score line are particularly accentuated, have a steeper slope below said score line 21 than in FIG. 8, in which a flow line 19*x* having a small slope in an area 19 below a score line 8 is accentuated.

Said state 19*x* is maintained in an area of the score line outside of said short section 24 for the new shaping of said score line 21 of FIG. 9, so that the flow lines change from a flat slope in the remaining portion to a steeper slope 38*x*,38*y* in the blocking or stopping portion.

Due to the geometry of the embossed score line pieces Q1,Q2 of FIG. 9, the original width b1 of the score line has been reduced to such an extent that the score line bottom 8*g* of FIG. 8*a* is designed to have a circular shape 48 according to FIGS. 9 and 9*a*, with walls 49*a*,49*b* becoming steeper along an inclined plane 37. Other depths and other distances of score line pieces Q1,Q2 do not cause such a strong modification of the score line bottom, so that the embodiment illustrated in FIG. 9 is an exaggerated embodiment.

Figure 5:
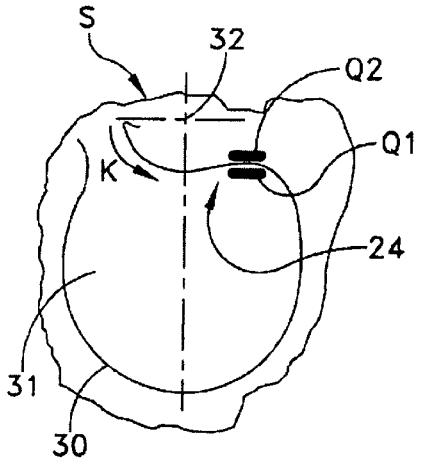
FIG. 5 shows in accordance with FIG. 2*b* an opening segment of the can end of FIG. 2*a* being provided with a system for stopping the opening according to a further embodiment.

The enlarged illustration of FIG. 9*a* particularly shows an elevation in the transitional portion 37*a*,37*b*, from the inclined walls 49*a*,49*b* of said section 24 towards the remaining central panel 20 and 30, respectively, of FIGS. 4 and 5. Said transitions proceed continuously between the wall and the remaining central panel, but have an elevation with respect to the plane, so that the particularly shaped flow lines in the inside also become visible from outside.

The design of another embodiment of an opening portion 33 according to FIG. 5 is corresponding. In this embodiment, an opening segment 33 in a central panel 30 is limited by a score line 31, said opening segment remaining at the can end and being opened with a not illustrated gripping tab fixed at a position 32. Embossments Q1,Q2 which are displaced laterally adjacent to the score line are arranged at a predetermined distance from said fixing position for stopping said opening process, said embossments corresponding to said score line pieces 27*a*,27*b*.

The degree of relief of tensions of the metal structure and thus, the extent of the stopping effect after the initial opening are dependent on the shape, size and position of the score line pieces 27*a*,27*b*,Q1,Q2, as well as on the remaining wall thickness d1 below said pieces. Said stopping effect may be controlled by the modification of the score line pieces outside (actually adjacent to) the openable score line.

List of Reference Numerals

1, 9 openable can end
7, 7*a* stopping portion
8, 11 score lines
21, 31 score lines
17, d2 normal remaining wall thickness
18, d3 increased remaining wall thickness
19 metal structure I
38 metal structure II
15, 35 can end sheet metal
42, d2 normal remaining wall thickness
k2 score line depth II
24 short section
25, L length
26, A distance
40, α flank angle of the score line pieces
27*a*, 27*b*, Q1, Q2 score line pieces

What is claimed is:

1. A can end made of sheet metal for containers having in a closed state an increased inner pressure compared to an ambient pressure, said can end comprising a substantially flat central panel, a portion in said central panel which is smaller with respect to the panel and is adapted to be broken out by tearing, the tearable portion being defined by a score line having two sides, and a tab adapted for gripping and used for opening said tearable portion, said tab being mounted at said central panel;

wherein along a longitudinally limited portion of said score line, following a starting portion of said score line, structure lines of sheet metal below said score line having a substantially higher density compared to a metal structure of sheet metal below at least adjacent score line portions and two line segments being provided near to said longitudinally limited portion at both sides thereof, for temporarily blocking an opening process after initially breaking said score line for tearing out said smaller portion.

2. The can end according to claim 1 wherein a remaining wall thickness below said score line in said longitudinally limited portion substantially corresponds to a remaining wall thickness of at least the adjacent portions of said score line.

3. The can end according to claim 1, wherein said two line segments are embossed in said central panel adjacent to said score line and on both sides thereof, said segments extending over a limited length, being smaller than the starting portion of said score line.

4. The can end according to claim 1 wherein at least one longitudinally limited embossed line is provided at a lateral distance from said score line in a limited section, said embossed line having a greater depth than said score line serving for opening.

5. The can end according to claim 1 wherein in a cross-sectional view at least one longitudinally limited line section is provided at its bottom with a rounded bottom profile, said profile being located at a distance from the score line section adapted as stopping or blocking section.

6. The can end according to claim 1, wherein a portion of a structure below said score line comprises one of flow and structure lines in said limited length, said structure lines having a steeper slope than flow or structure lines in two sections of the score line which are adjacent to said limited length on both longitudinal ends thereof.

7. A can end made of sheet metal for beverage cans, which, in a closed state have an increased inner pressure compared to an ambient pressure, said can end comprising a substantially flat central panel, a portion in said central panel which is smaller with respect to the panel and is adapted to be broken out of said panel by tearing, said portion being defined by a score line, and a tab adapted for gripping and serving for opening said portion, said tab being mounted at said central panel; wherein said score line comprises two side walls and a score line bottom, wherein one of:

(a) in a longitudinally limited section or limited length, both side walls have a steeper slope than in adjacent sections; and (b) in a limited length, said side walls proceed over an elevation, forming a transition into said central panel, whereas outside of said limited length, said side walls continue to extend into said central panel without an elevation.

8. A method of manufacturing a can end comprising a central panel, said method including:

in a first manufacturing step, embossing an openable score line, serving for opening said can end, in a central panel of said can end for defining an opening area segment and in a second step providing a metal structure constitution of a wall remainder, remaining below said openable score line, that is compacted in relation to a structural constitution of metal portions located below adjacent sections of said score line, said compaction being provided along a limited length of said score line by two laterally neighbored portions of embossment, both next to said limited length of score tine.

9. A method of manufacturing a can end comprising a score line protected against burst opening said method including embossing, squeezing or stamping alone no more than a short length of a score line extension, embossed for opening said can end, a sheet metal of the can end in a line-shape fashion on two lateral sides of said score line for one of compacting a metal structure below said score line and providing a burst stopping or a blocking segment in said short length, said length being relieved from tensile stresses.

10. The method according to claim 8, wherein a metal structure of flow lines in a structural constitution of the remaining wall below said score line serving for opening is compacted and relieved from inner stresses by bilaterally compressing said can end sheet metal along said limited length of the score line and at a lateral distance with regard to said limited length portion of the score line, said compression corresponding to said first manufacturing step.

11. The method according to claim 8 wherein after said step of embossing said openable score line, two additional score-shaped sections are embossed in a second manufacturing step.

12. The method according to claim 9 wherein the two line shapes are embossed, providing a modification of the metal structure below said openable score line, and wherein the line shapes have a second depth exceeding a first depth of said score line.

13. The method according to claim 10, wherein the bilateral compression provides a stress-neutral zone, said zone having a higher transversal resistance or shearing strength below said score line than those sections of the score line starting from both longitudinal ends sides of said limited length, regarded in direction of the score line.

14. A can end for closing a container, the can end made of metal and comprising an opening system, the container, in a closed state, being under one of overpressure and low pressure, said system comprising a score line defining an opening portion of said can end, said portion being adapted to be broken out along said score line, and a tab serving for opening said portion and being attached to said can end, wherein a means is provided for controlling a course of an opening process, upon initially opening said can end by beginning to break out said opening portion; wherein said means is a first metal structure laterally adjacent to a short and limited length of said score line, and an opposite metal structure also laterally adjacent to said limited length, wherein below the score line limited length, an inner stress of a metal of a metal structure being at least weaker than below other portions of the score line.

15. The can end according to claim 14, wherein along said short length said score line has a smaller width than in adjacent portions of said short length.

16. The can end according to claim 15, wherein a first width of said limited length of said score line is substantially 30% to 70% of a second width of a score line part, longitudinally adjacent of said score line limited length.

17. The can end according to claim 1, wherein the at least adjacent score line portions comprise the score line, except the longitudinally limited portion.

18. An end of a container comprising:

a central panel having a removable-portion defined by a score line and having a first end and a second end;

a pull-tab mounted to said removable-portion at said first end so that when said pull-tab is pulled away from said central panel, said removable-portion tears away from said central panel along said score line from said first end toward said second end; wherein, a section of said central panel disposed adjacent to said first end and said score line includes two neighbored longitudinally extending depressions for providing below said score line at least one of a weaker inner stress and substantially higher density relative to a remainder of said central panel below at least adjacent sections of score line thereby temporarily blocking said tearing along said score line as said removable-portion tears away from said central panel.

19. An end of a container comprising:

a central panel having a removable-portion defined by a score line and having a first end and a second end;

a tab having a gripping end and an engagement end and pivotably mounted to said central panel adjacent to said first end of said removable-portion so that when said gripping end is pivoted away from said central panel, said engagement end presses said first end of said removable-portion so as to cause said removable-portion to tear away from said central panel along said score line from said first end; wherein a section of said central panel disposed adjacent to said first end and said score line has two neighbored longitudinally extending depressions for providing below said score line at least one of a weaker inner stress and a substantially higher density relative to a remainder of said central panel below at least adjacent sections of said score line thereby temporarily blocking said tearing along said score line as said removable-portion tears away from said central panel.

20. The can end of claim 15, wherein the width of said limited length is less than 50% of a width of the score line outside said limited length.

21. A method of manufacturing a can end comprising a central panel, said method including:

in a first manufacturing step, embossing an openable score line serving for opening said can end, defining an opening area segment in the central panel of said can end, in a second step, providing a metal structure of a wall remainder remaining below said openable score line, that is compacted in relation to a structure constitution of metal portions located below adjacent sections of said score line, said compaction being provided along a limited length of said score line by two laterally neighbored portions of embossment both next to said limited length of score line.

22. The method according to claim 21, wherein a metal structure of flow lines in a structural constitution of the remaining wall below said score line serving for opening is compacted and relieved from inner stresses by bilaterally compressing said can end sheet metal along said limited length of the score line and at a lateral distance with regard to said limited length portion of the score line, said compression corresponding to said first manufacturing step.

23. The method according to claim 21 wherein after said step of embossing said openable score line, two additional score-shaped sections are embossed in a second manufacturing step.

24. The method according to claim 22, wherein the bilateral compression provides a stress-neutral zone, said zone having a higher transversal resistance or shearing strength below said score line than those sections of the score line starting from both longitudinal ends of said limited length, regarded in direction of the score line.

* * * * *